US006883731B2

(12) United States Patent
Pivovarov

(10) Patent No.: US 6,883,731 B2
(45) Date of Patent: Apr. 26, 2005

(54) APPARATUS FOR DISCHARGING COMMINGLED FLUIDS

(76) Inventor: Alexander R. Pivovarov, 10189 W. Sample Rd., Coral Springs, FL (US) 33065

( * ) Notice: Subject to any disclaimer, the term of this patent is extended or adjusted under 35 U.S.C. 154(b) by 192 days.

(21) Appl. No.: 10/396,981

(22) Filed: Mar. 25, 2003

(65) Prior Publication Data

US 2004/0188545 A1 Sep. 30, 2004

(51) Int. Cl.[7] ..... B05B 7/12

(52) U.S. Cl. ..... 239/413; 239/487; 239/501; 239/463; 251/208

(58) Field of Search ..... 239/424, 434, 239/526, 413, 430, 428, 463, 468, 471, 487, 500, 501; 251/208, 209

(56) References Cited

U.S. PATENT DOCUMENTS 441,048 A * 11/1890 Bacon ..... 239/487
2,307,014 A * 1/1943 Becker et al. ..... 239/438
2,999,512 A * 9/1961 Barkow ..... 137/614.16
4,505,431 A 3/1985 Huffman
4,569,482 A 2/1986 Hiruma
5,221,026 A 6/1993 Williams
5,570,870 A * 11/1996 Bilgery ..... 251/208

FOREIGN PATENT DOCUMENTS

WO WO 01/10577 2/2001

* cited by examiner

*Primary Examiner*—Dinh Q. Nguyen
(74) *Attorney, Agent, or Firm*—Mark D. Bowen, Esq.; Stearns Weaver Miller Weissler Alhadeff & Sitterson, P.A.

(57) ABSTRACT

A fluid discharge apparatus adapted for to commingling two pressurized fluids, such as a pressurized liquid and a pressurized gas, and for discharging the commingle fluids in a high pressure spiral stream that is particularly useful in washing dirt, debris, barnacles, and other substances from surfaces. The fluid discharge apparatus is adapted with a barrel having internal spirally disposed baffles that induce rotation in the flowing fluids thereby producing a spiral flow. Cavitation results from the spiral flow thereby creating an axial region of low pressure that draws the gas radially inward resulting in a composite stream including a rotating stream of liquid surrounding a concentrically disposed stream of gas.

9 Claims, 21 Drawing Sheets

Flow chart of process

APPARATUS FOR DISCHARGING COMMINGLED FLUIDS

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights.

BACKGROUND OF THE INVENTION

1. Field of the Invention

The present invention relates generally to fluid discharging apparatus, and, more particularly, to an apparatus and method of commingling two pressurized fluids, such as a liquid and a gas, and discharging the commingled fluids in concentric spiral streams at a user controlled flow rate, whereby the commingled fluids are useful in cleaning surfaces.

2. Description of the Background Art

Various devices exist for dispensing mixtures of liquids and pressurized gas. Such devices are commonly used in pressure washing, the application of liquid fertilizers, snow making, foam making, as well as a variety of other applications. These prior art devices are generally characterized as having inlet ports for receiving the fluids, internal mixing chambers for commingling the fluids, and at least one outlet port for discharging the fluids.

There exists a need for an improved fluid discharging apparatus adapted to commingle a pressurized liquid and a pressurized gas, and to discharge the commingled fluids in a high pressure spiraling stream characterized by an outer stream of spiraling liquid and a concentrically inner spiraling stream of gas.

BRIEF SUMMARY OF THE INVENTION

The present invention provides an improved fluid discharge apparatus adapted to commingle two fluids, namely a pressurized liquid and a pressurized gas, and to discharge the commingle fluids in a high pressure spiral stream that is particularly useful in washing dirt, debris, barnacles, and other substances from surfaces. The fluid discharge apparatus is adapted with a barrel having internal spirally disposed baffles that induce rotation in the flowing fluids thereby producing a spiral flow. The spiral flow creates an axial region of low pressure which draws the gas radially inward resulting in a composite stream including a rotating stream of liquid surrounding a concentrically disposed stream of gas.

Accordingly, it is an object of the present invention to provide an improved fluid handling apparatus for discharging commingled fluid streams.

Still another object of the present invention is to provide a fluid handling apparatus for discharging a composite stream composed of liquid and gas.

Yet another object of the present invention is to provide a fluid handling apparatus for discharging a rotating stream of liquid surrounding a concentrically disposed stream of gas.

Still another object of the present invention is to provide an improved method of cleaning surfaces using a pressurized spray.

A further object of the present invention is to provide an improved method of cleaning marine deposits from submerged surfaces.

In accordance with these and other objects, which will become apparent hereinafter, the instant invention will now be described with particular reference to the accompanying drawings.

DETAILED DESCRIPTION OF THE INVENTION

With reference now to the drawings there is depicted a fluid discharge apparatus, generally referenced as 10, suitable for use in pressure cleaning. Fluid discharge apparatus 10 is adapted to commingle two fluids, preferably a pressurized liquid and a pressurized gas, and to discharge the commingle fluids in a high-pressure stream wherein the gas is disposed in the center of a stream of swirling liquid. As discussed more fully below, the pressurized stream is particularly useful in removing deposits from surfaces, and particularly useful in removing marine deposits from submerged surfaces.

Figure 1:
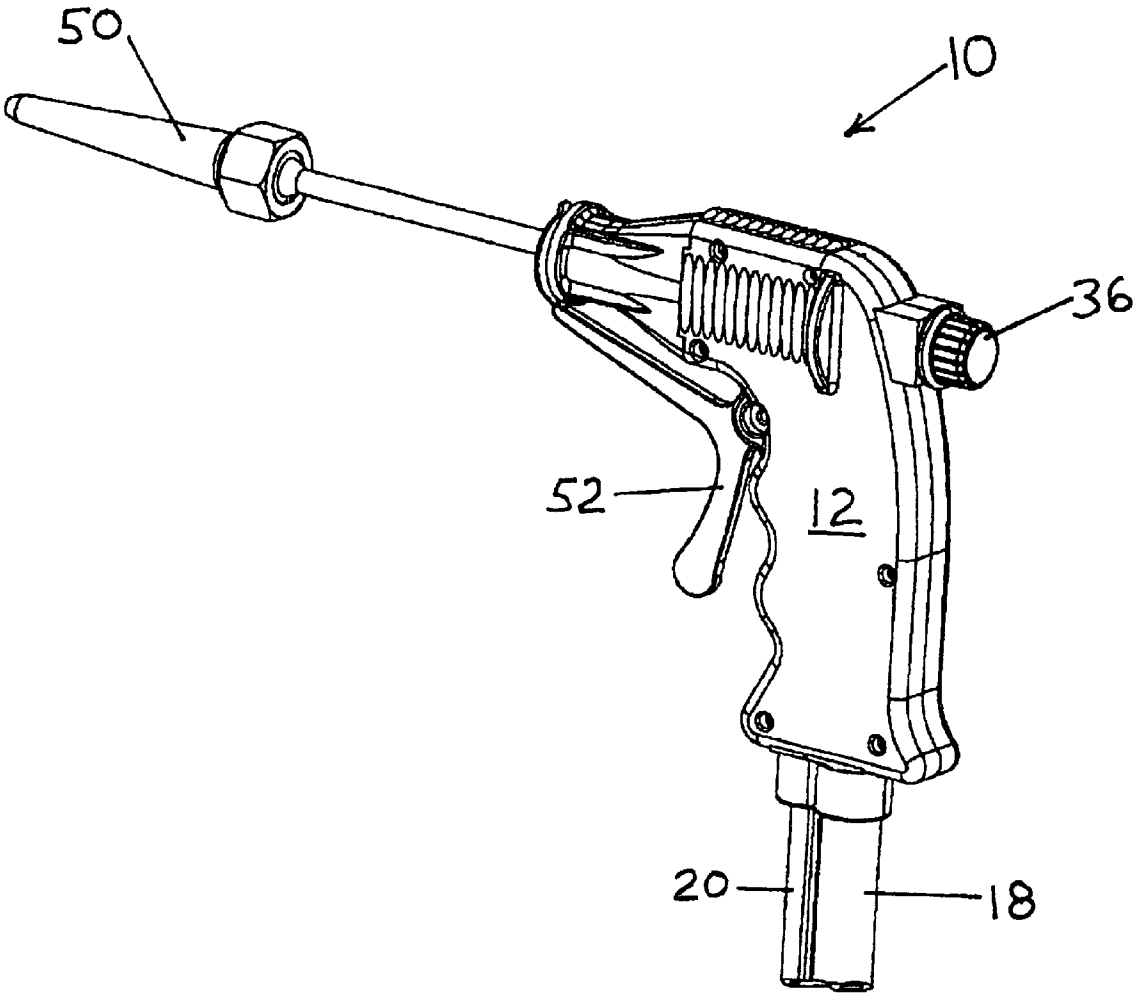
FIG. 1 is a perspective view of a fluid discharge apparatus according to the present invention.
Figure 2:
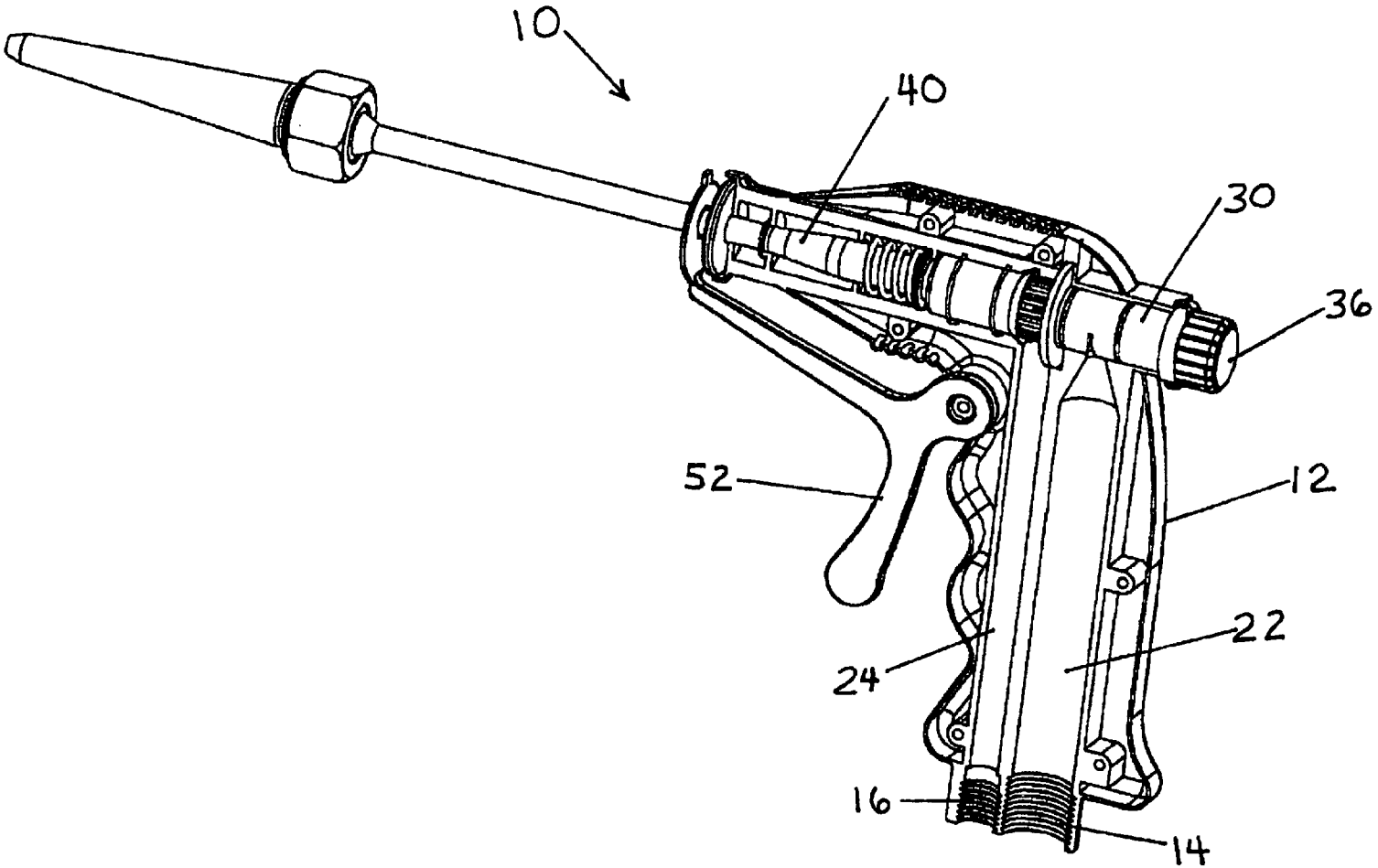
FIGS. 2–5 are partial cross-sectional views thereof.
Figure 3:
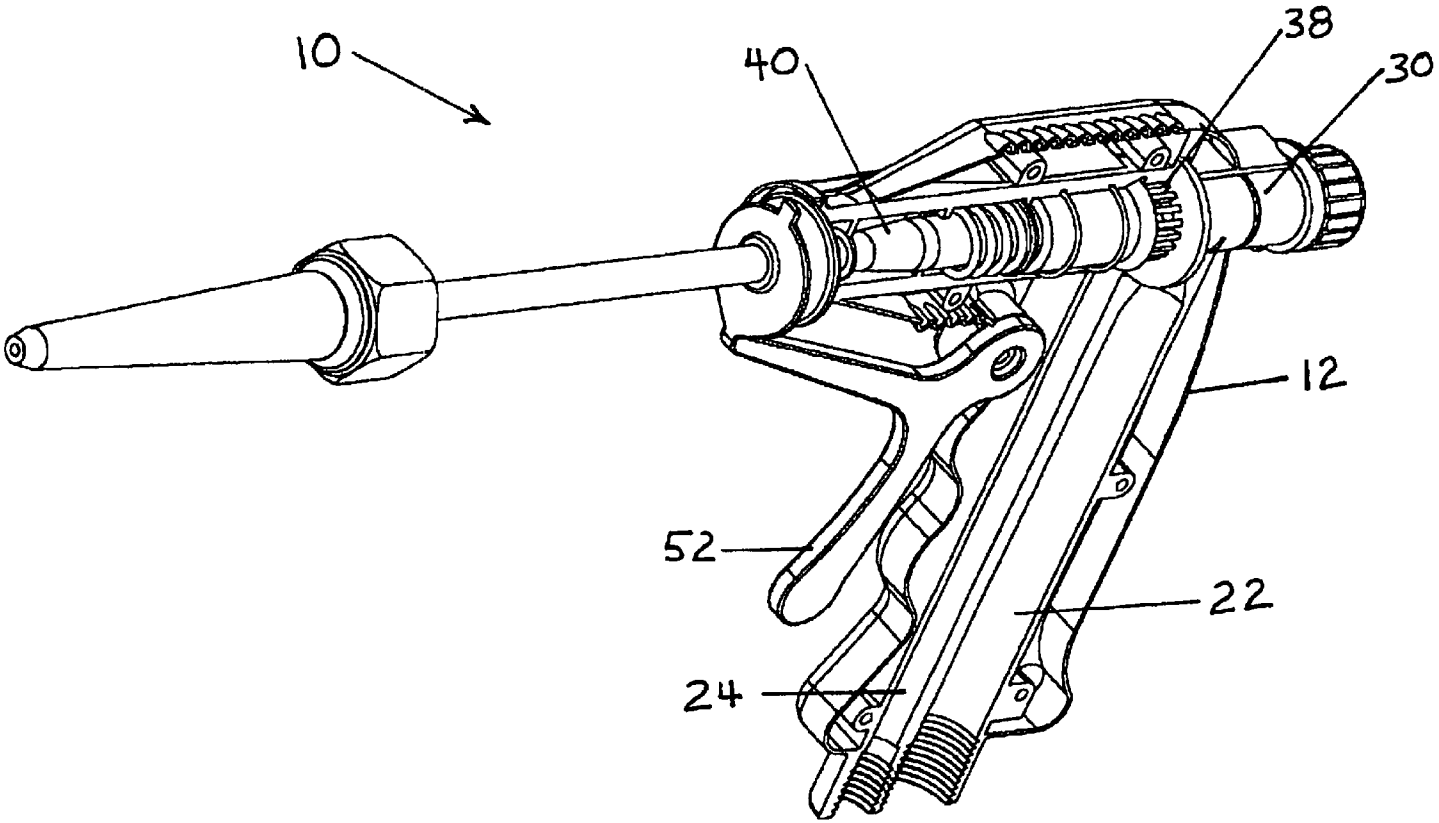
Figure 4:
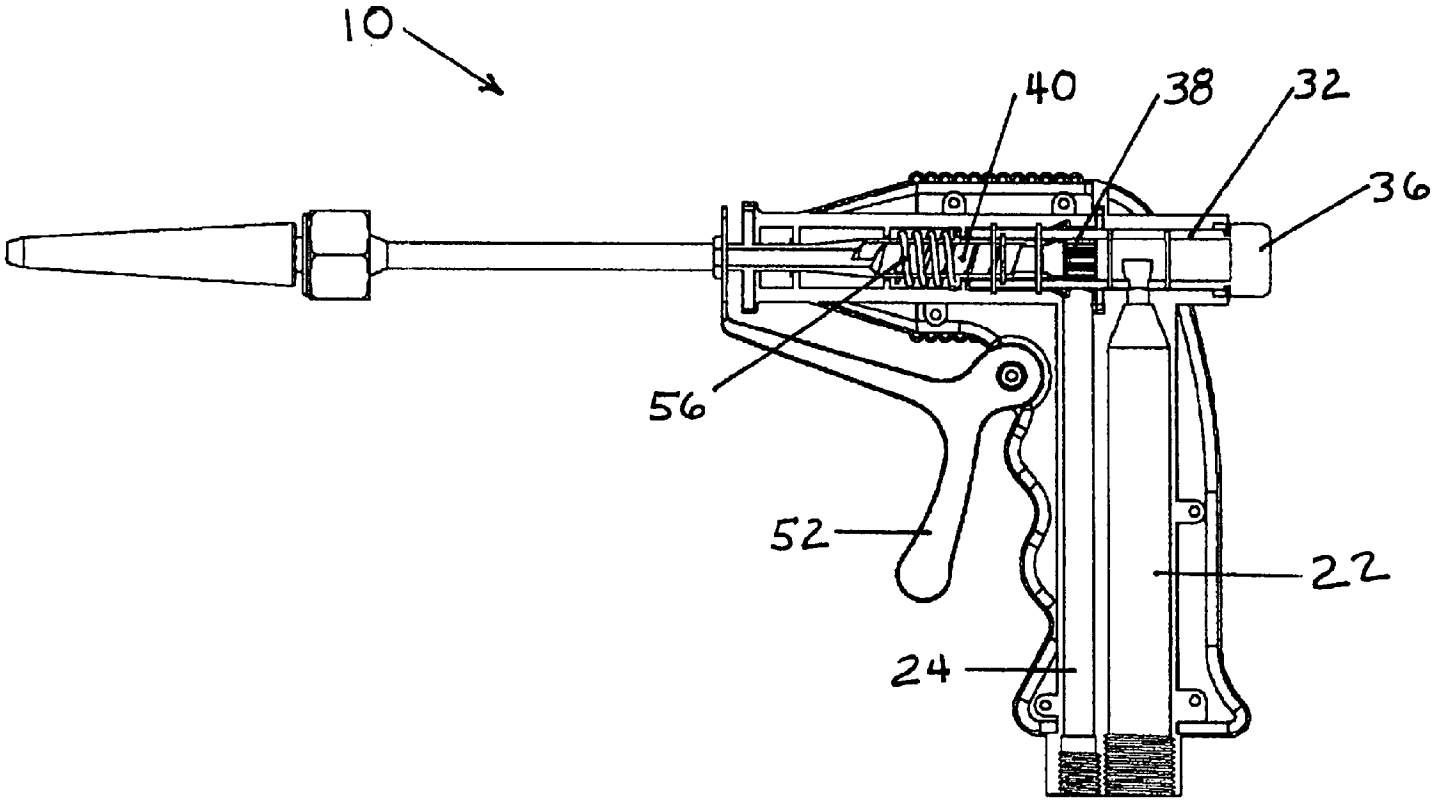
Figure 5:
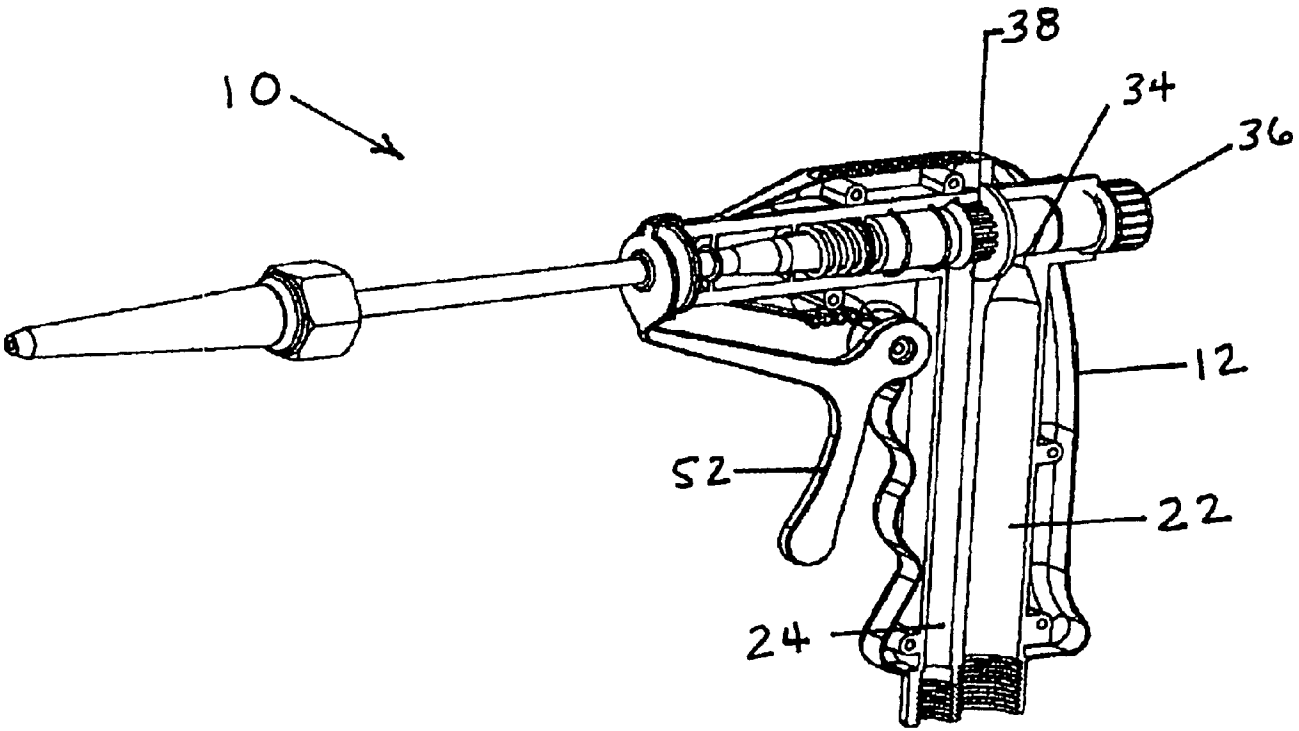
Figure 6:
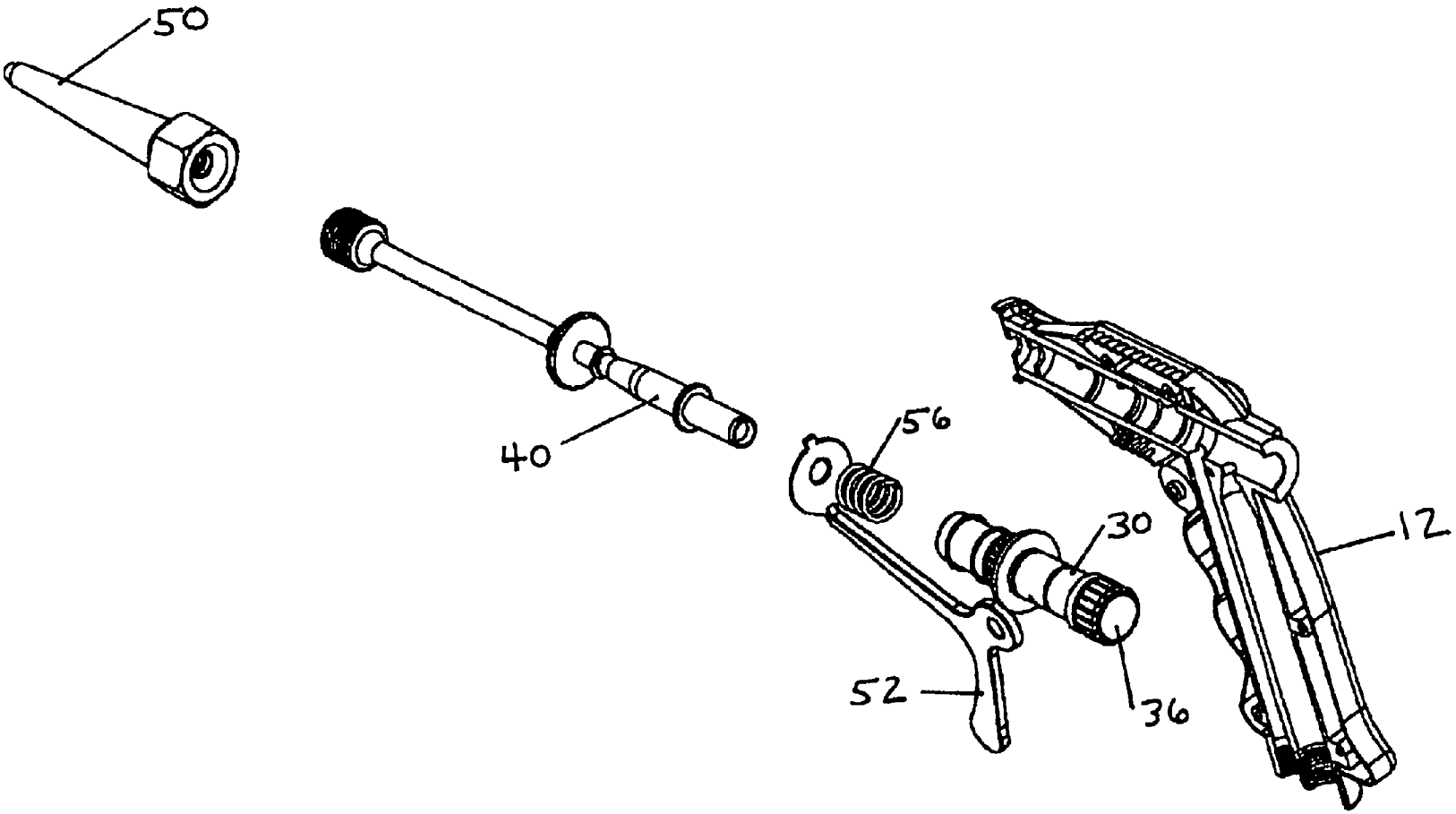
FIGS. 6 and 7 are exploded views thereof.
Figure 7:
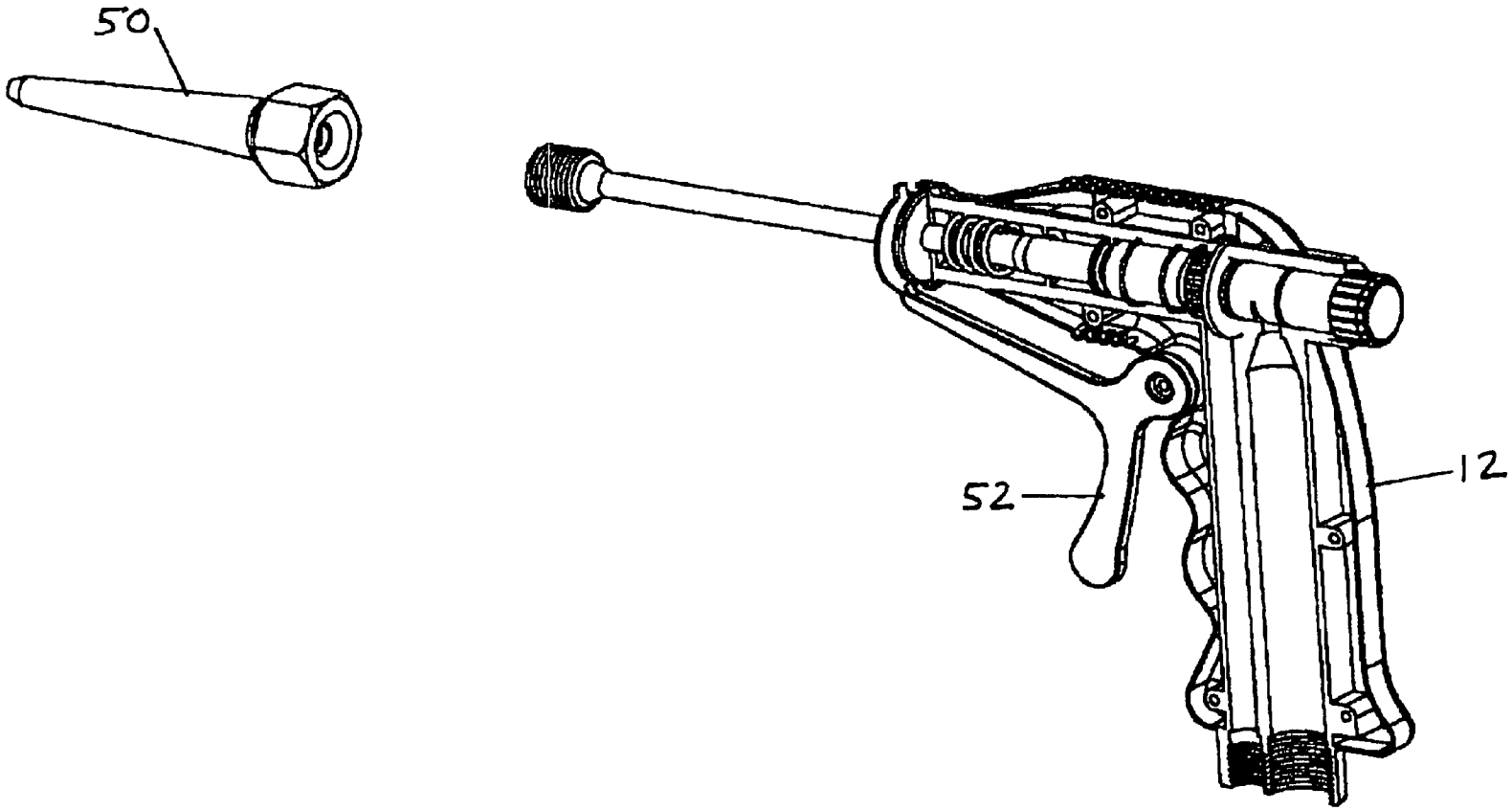

As best depicted in FIGS. 1–7, fluid discharge apparatus 10 includes a pistol grip shaped housing 12 having a handle adapted with internally threaded ports, referenced as 14 and 16, for receiving first and second pressurized fluids via inlet hoses 18 and 20. In a preferred embodiment, the first and second pressurized fluids comprise water and air respectively. Pressurized water flows through water inlet hose 18 into a water inlet channel 22 defined in the handle portion of housing 12, and pressurized air flows through air inlet hose 20 into an air inlet channel 24 defined in the handle portion of housing 12.

Water inlet channel 22 terminates in communication with an adjustable water flow regulator assembly 30. In a preferred embodiment, water flow regulator assembly 30 includes a generally hollow cylindrical member 32 having a wall defining a circumferential slotted opening 34 through which water may flow. Slotted opening 34 defines an opening area that originates at a first circumferential point and expands toward termination at a second circumferentially spaced point. Cylindrical member 32 is adjustable by rotation thereof, and includes a rotatable knob 36 disposed external to housing 12 for enabling user adjustment of the water flow rate. Rotation of knob 36 positions cylindrical member 32, and particularly slotted opening 34, relative to water inlet channel 22 such that the flow rate of water is regulated based on the size slotted opening disposed in aligned communication with water inlet channel 22. Flow regulator assembly 30 further includes a plurality of circumferentially disposed apertures, referenced as 38, aligned with air inlet channel 24 so as to allow for the commingling of pressurized air and water.

The flow regulator assembly has an outlet in communication with a rotational flow-inducing barrel 40. Barrel 40 is a generally tubular member that functions as a conduit for the commingled fluid. Barrel 40 has an inner wall defining radially inwardly projecting spiral baffles, referenced as 42. A significant aspect of the present invention relates to the use of the spiral baffle structure to induce rotational flow in the fluids (e.g. liquid and gas) flowing therethrough. More particularly, spiral baffles 42 function to cause commingled liquid and gas (e.g. water and air) to flow in a spiral path while traveling through barrel 40. By causing the fluids to flow in a spiral path an axial region of low pressure is formed which draws gas bubbles into the axial region. In addition, causing the flow to swirl maximizes commingling of the fluids such that the liquid becomes saturated with gas. Consequently, a composite stream is formed with water (saturated with air) existing at the periphery of the stream and air bubbles existing in the center region of the stream. The spiral flow thereby creates an axial region of low pressure which draws the gas radially inward resulting in a composite stream including a rotating stream of liquid surrounding a concentrically disposed stream of gas. The composite stream is discharged from the apparatus through a nozzle 50.

A trigger, referenced as 52, functions to vary the flow rate of the discharge stream. In a preferred embodiment, trigger 52 has a connection point that is pivotally connected to housing 12, and an end 54 that is connected to barrel 40. Barrel 40 includes a spring 56 that biases the barrel into sealing engagement with the flow regulator assembly 30 in a configuration wherein flow is shut off. User actuation of trigger 52 moves barrel 40 away from regulator assembly 30 thereby allowing the pressurized liquid and gas to enter barrel 40 whereafter the commingled fluid stream is discharged from nozzle 50.

Figure 8:
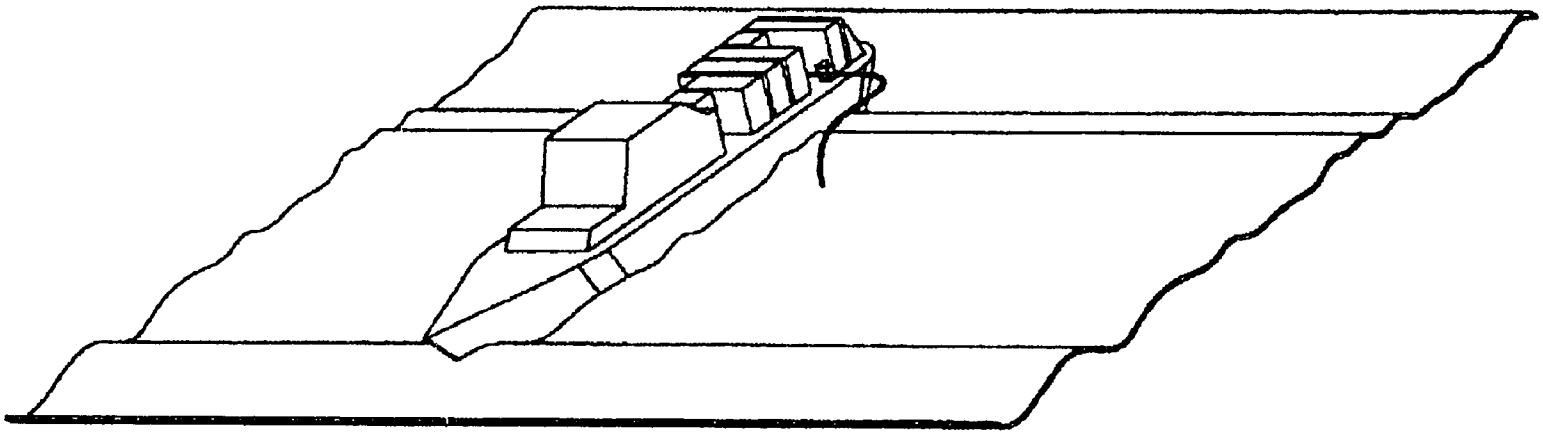
FIGS. 8–11 illustrate use of the fluid discharge apparatus in a marine environment to clean the hull of a marine vessel.
Figure 9:
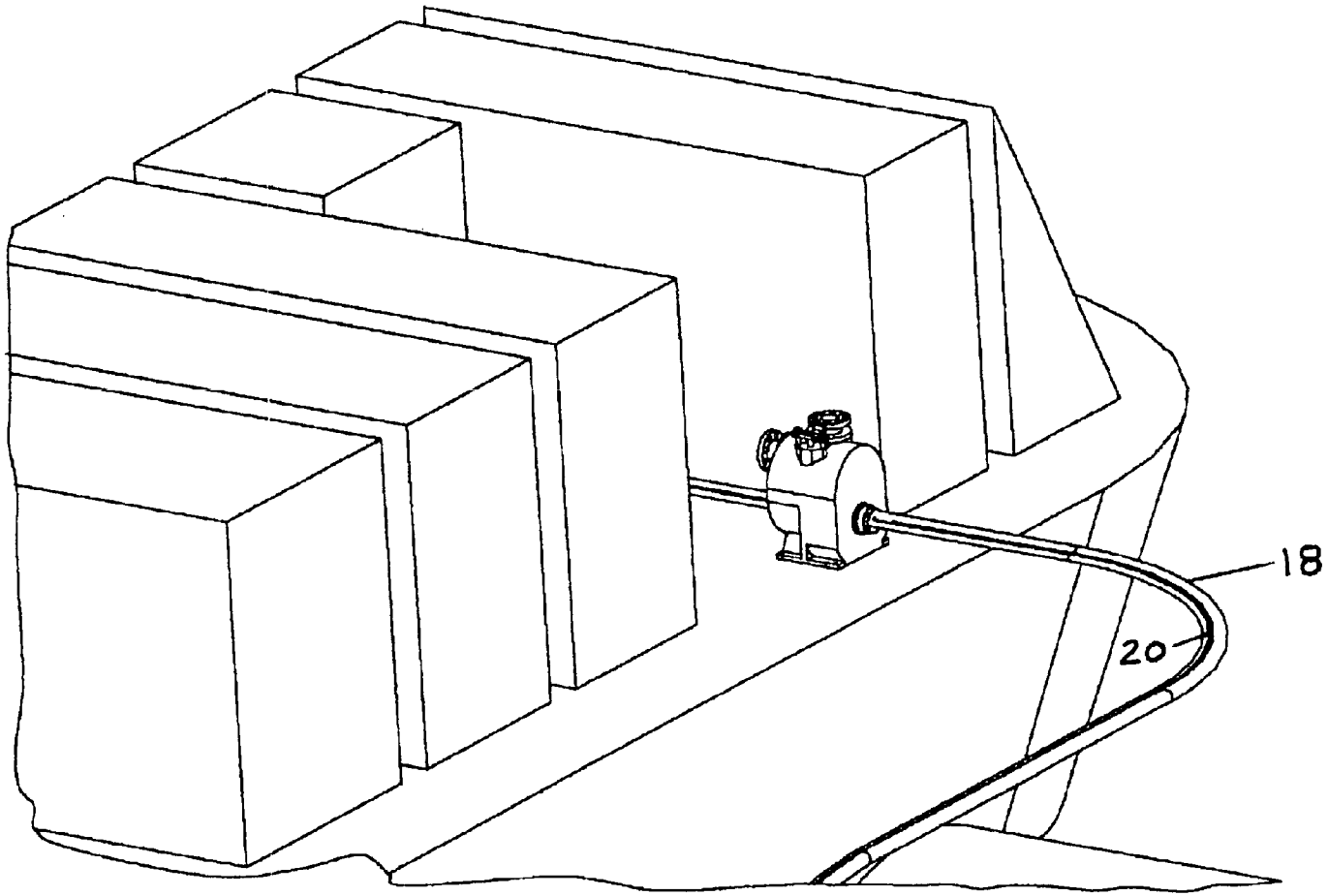
Figure 10:
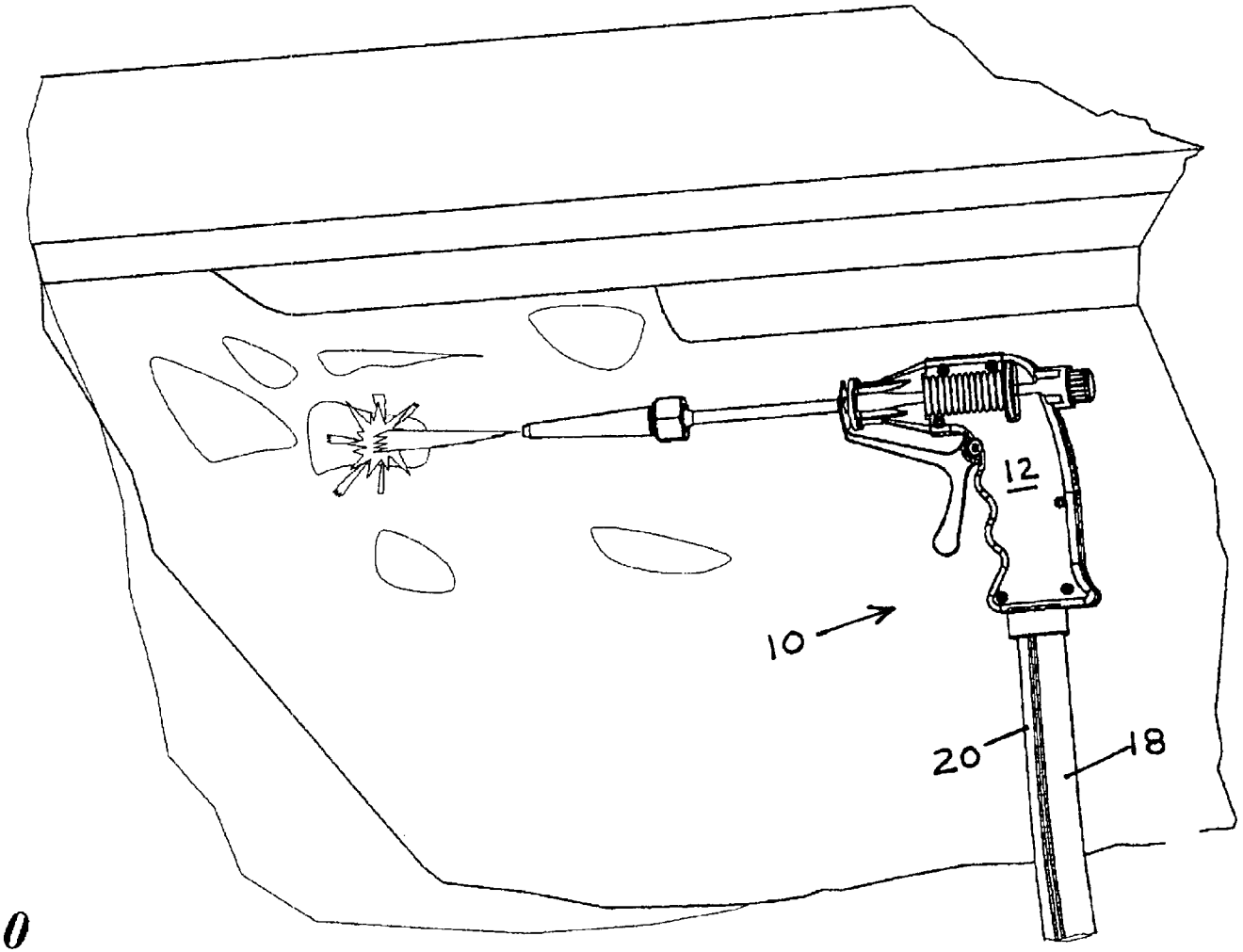
Figure 11:
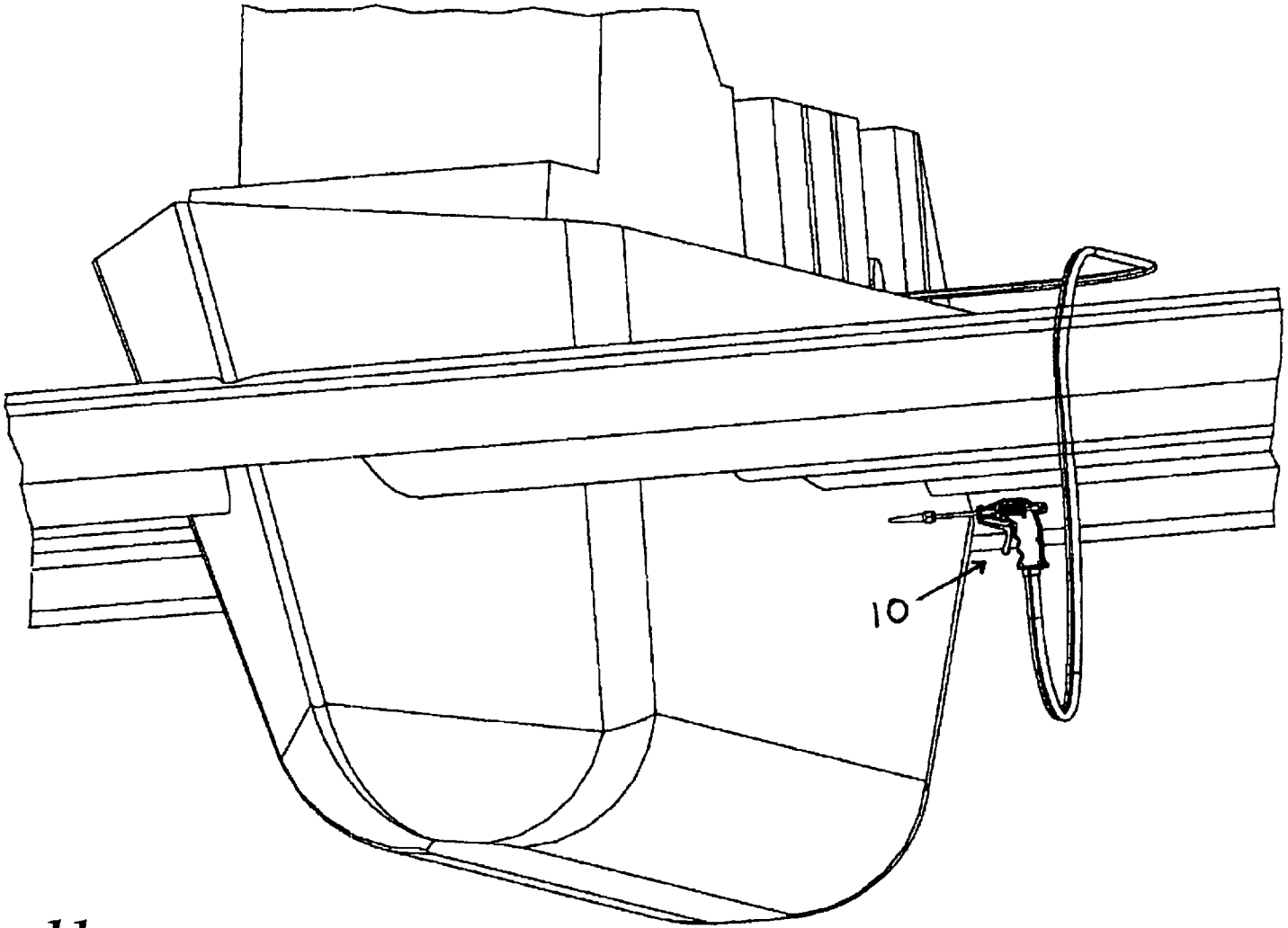
Figure 12:
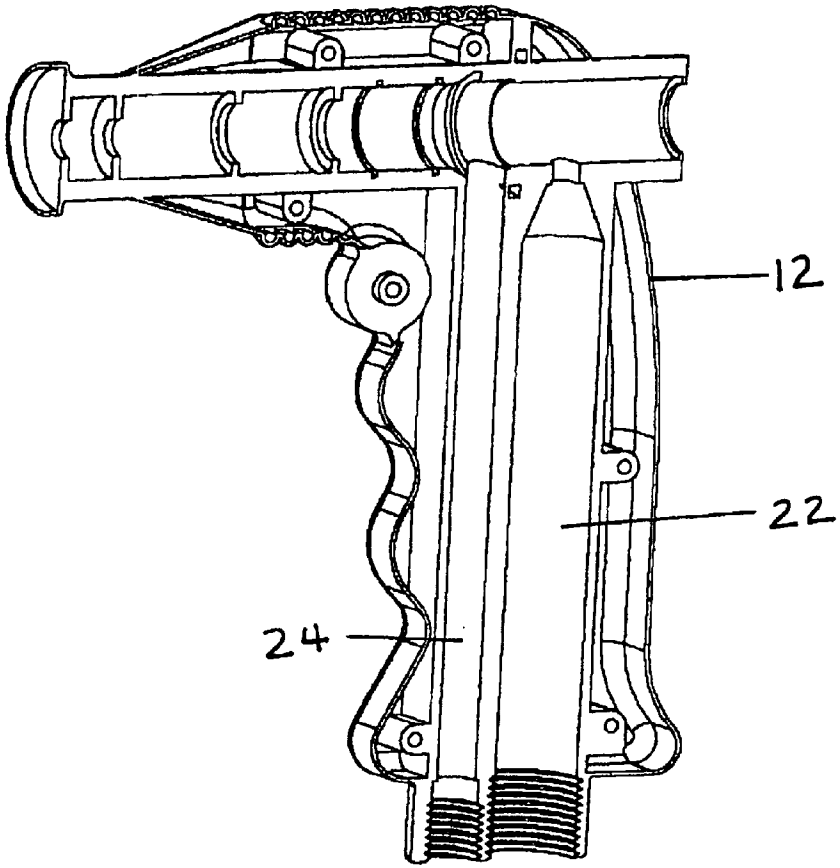
FIG. 12 is a cross-sectional view of the handle forming housing.
Figure 13:
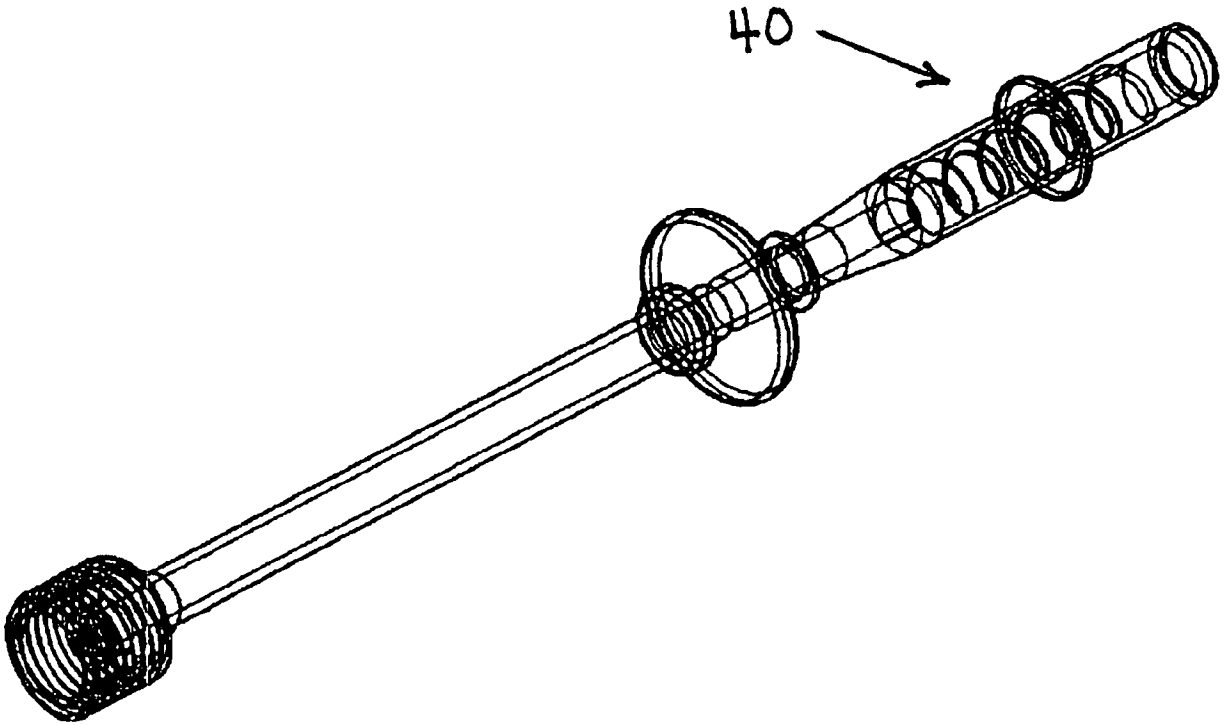
FIG. 13 is a perspective transparent view of the barrel section of the fluid discharging apparatus.
Figure 14:
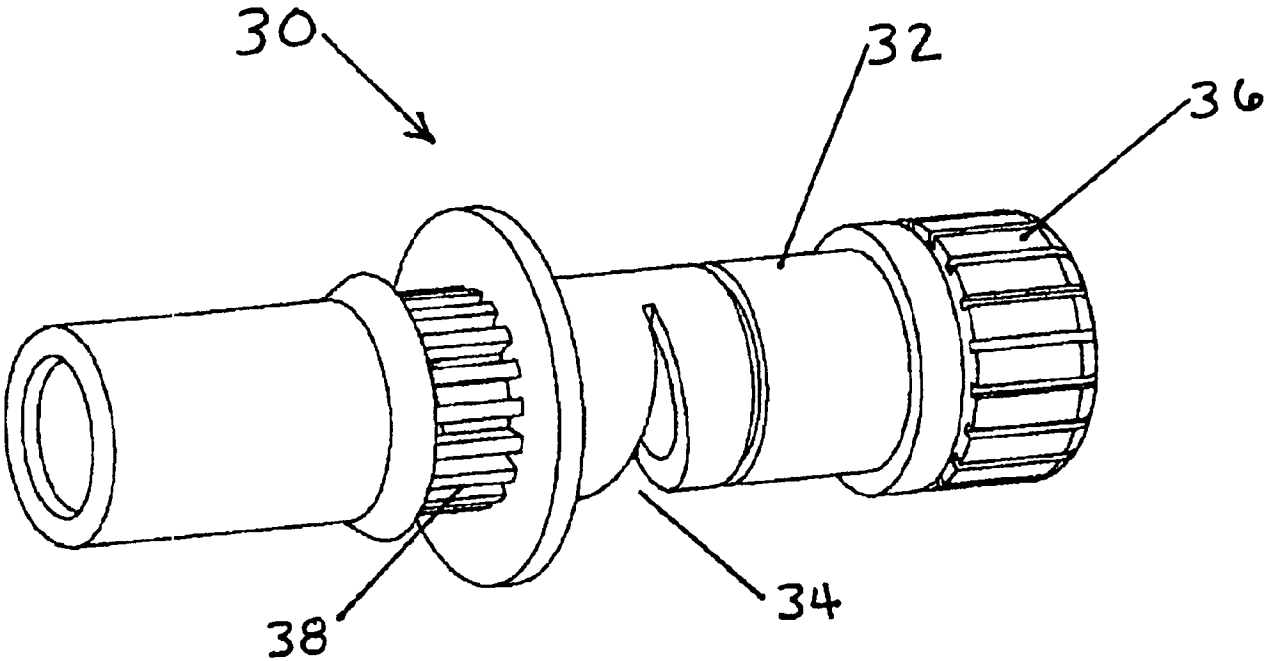
FIG. 14 is a perspective view of a fluid handling component adapted for engagement with the barrel section.
Figure 15:
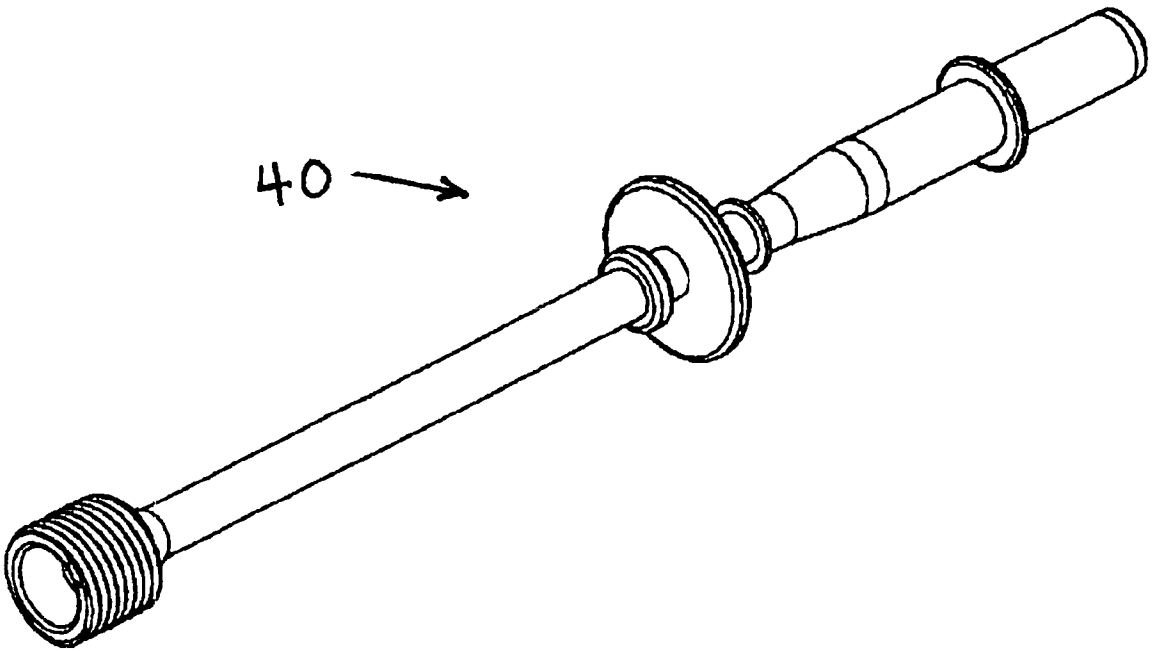
FIG. 15 is a perspective view of the barrel section of the fluid discharging apparatus.
Figure 16:
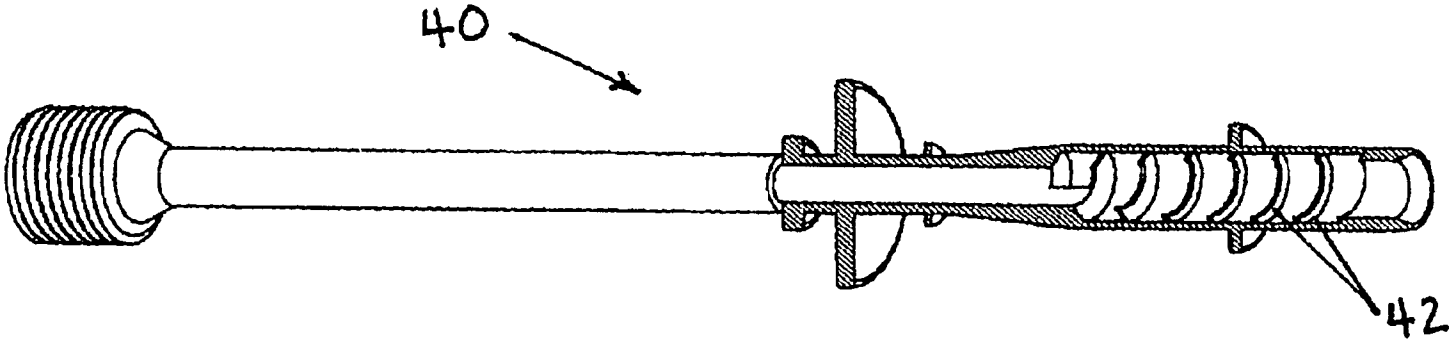
FIG. 16 is a partial cross-sectional view thereof.
Figure 17:
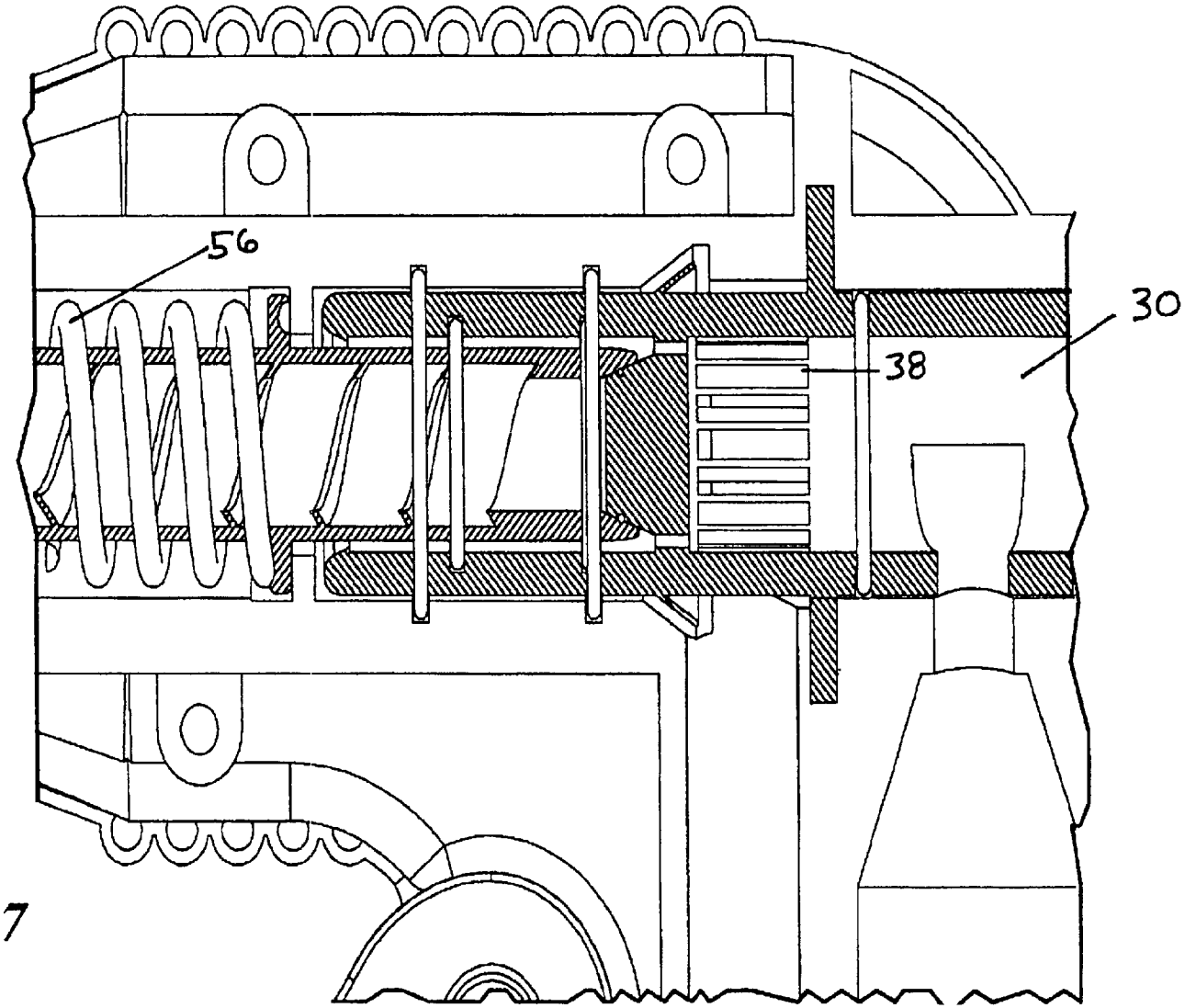
FIG. 17 is a partial cross-sectional view of the fluid discharging apparatus.
Figure 18:
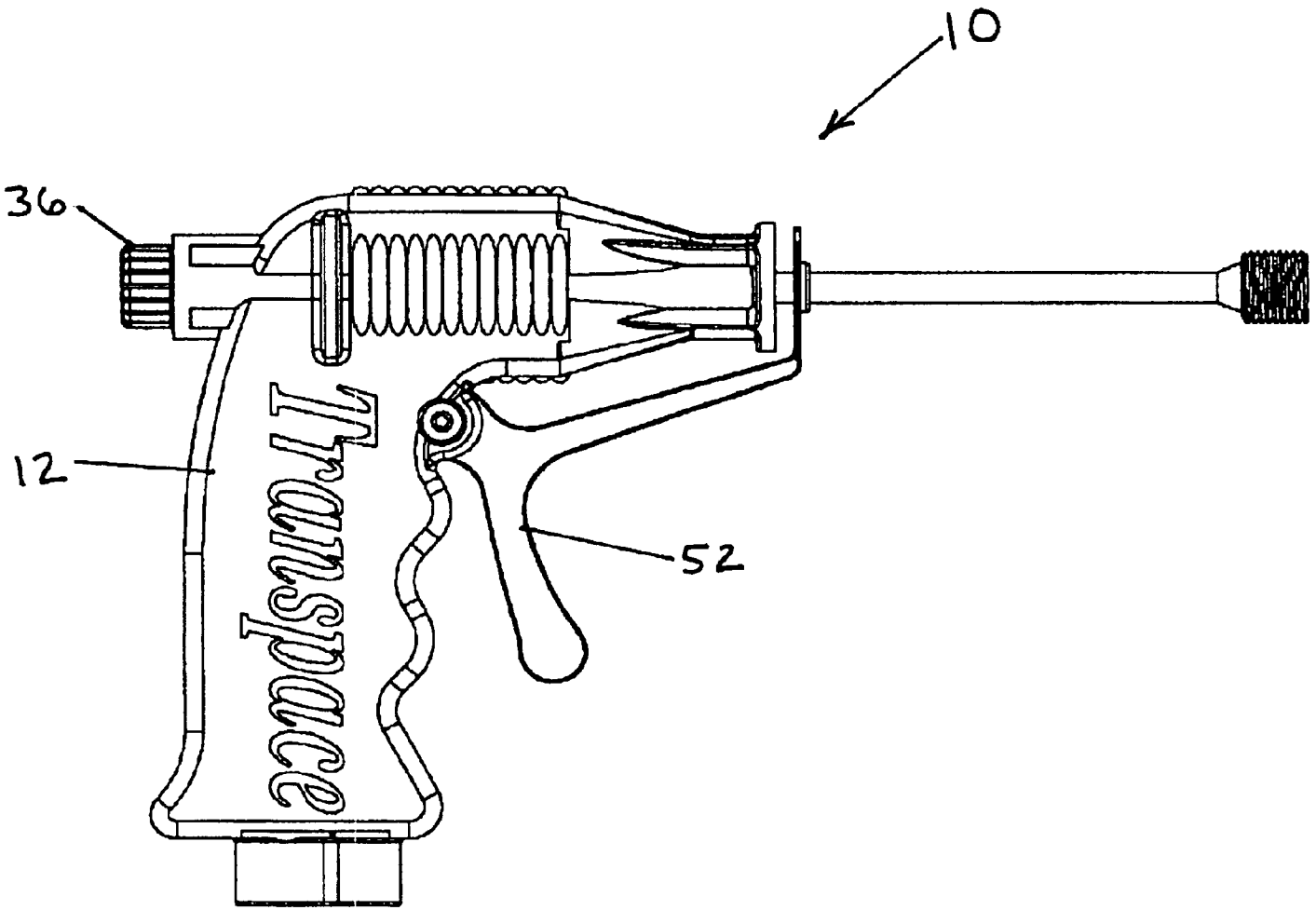
FIG. 18 is a side view of a fully assembled fluid discharging apparatus, less the nozzle.
Figure 19:
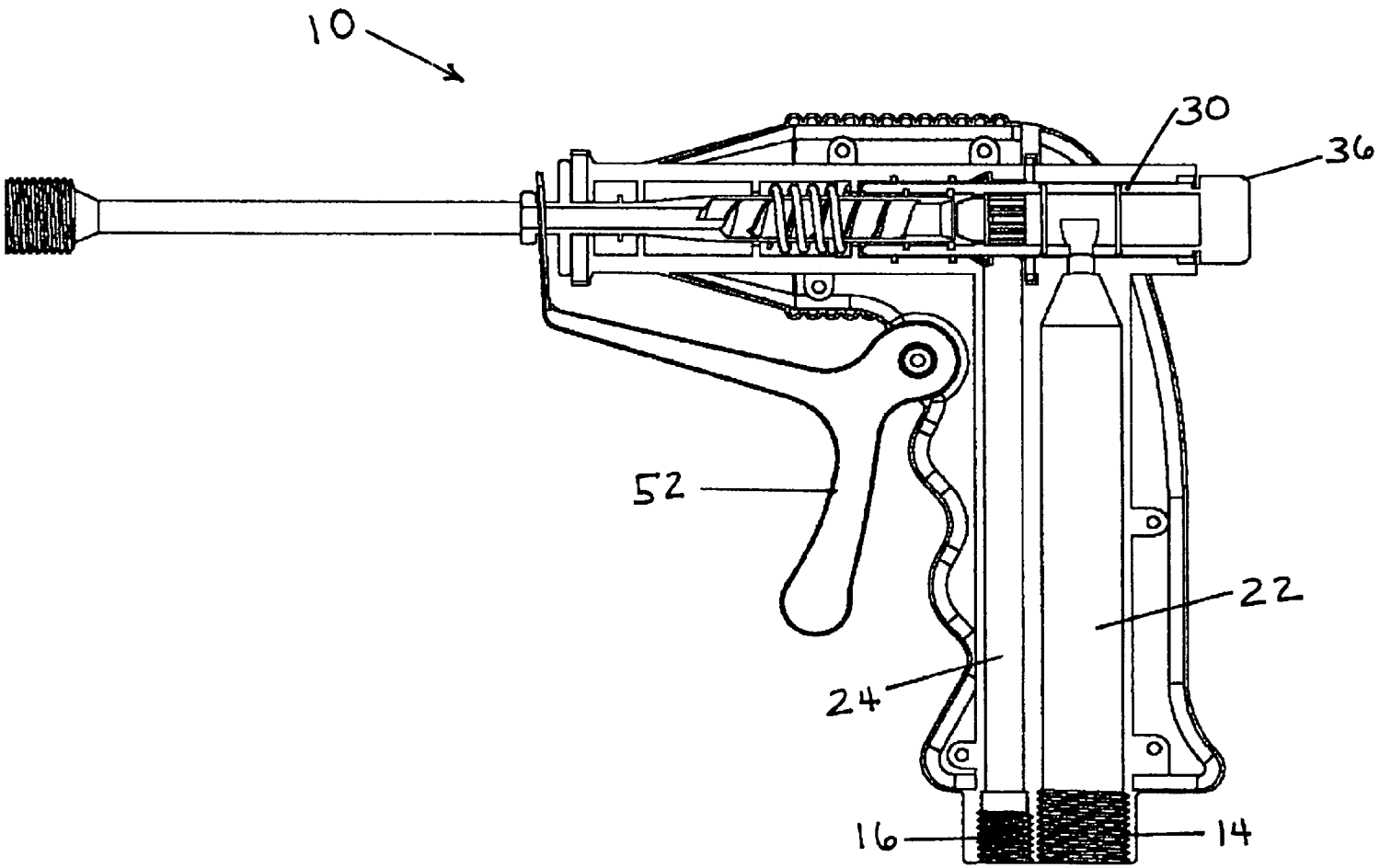
FIG. 19 is a partial sectional view thereof.
Figure 20:
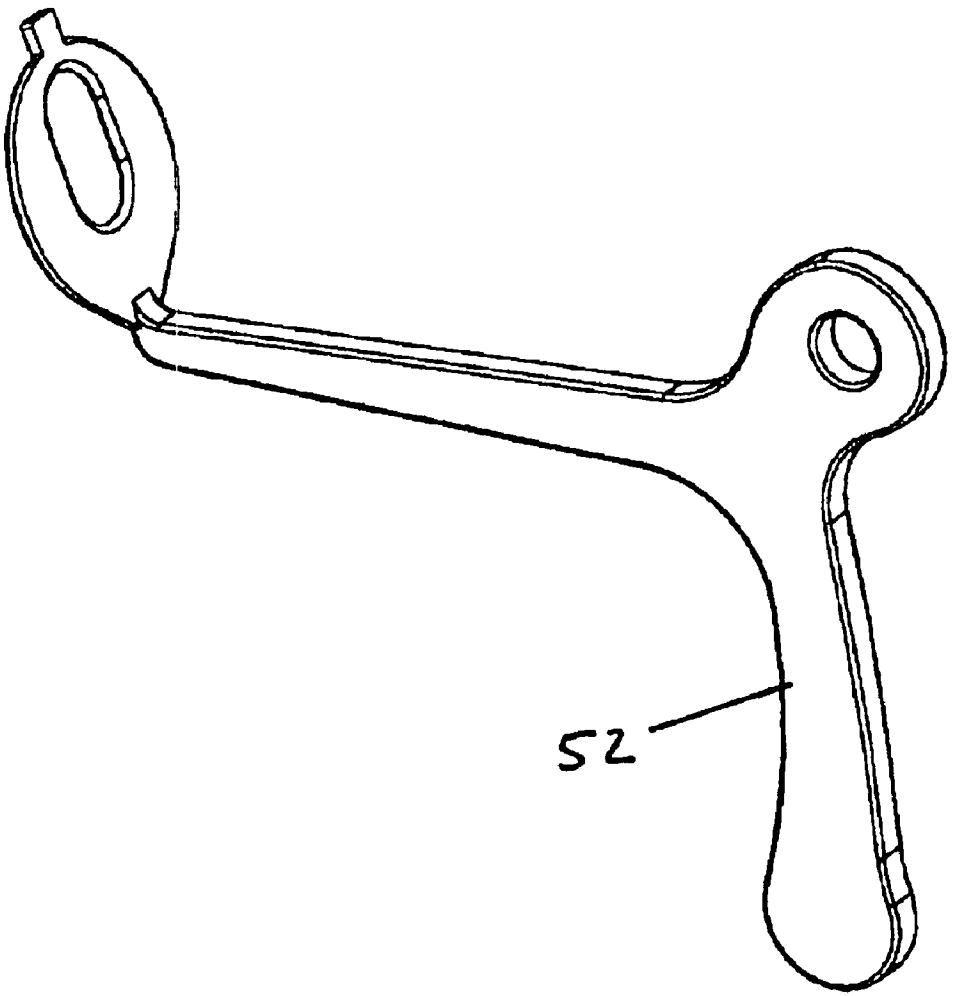
FIG. 20 is a detailed view of the flow adjusting trigger mechanism.
Figure 21:
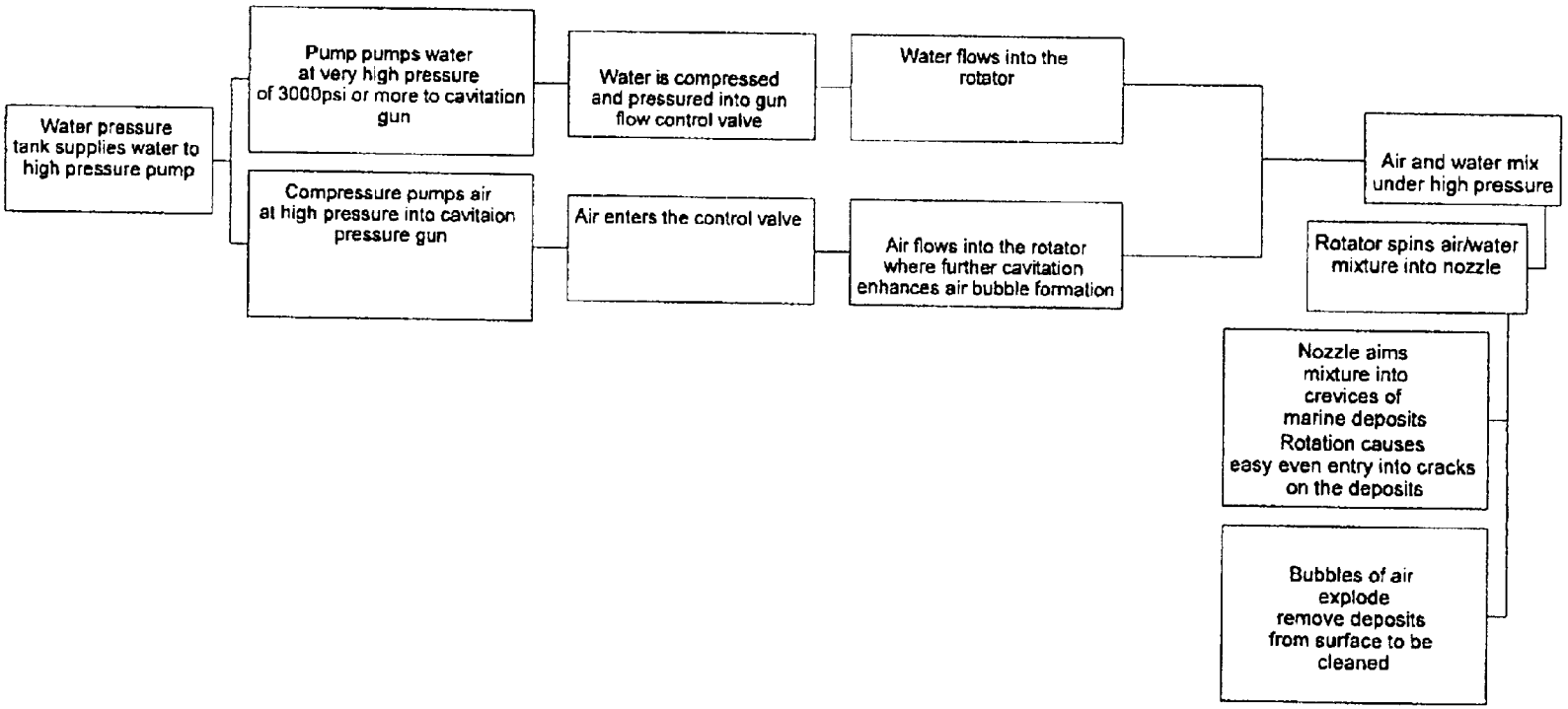
FIG. 21 is a flow chart depicting the fluid handling process.

As best depicted in FIGS. 8–11, the present invention is particularly useful in removing marine debris from submerged surfaces. In a preferred embodiment, pressurized water and air are supplied to the fluid discharge apparatus by hoses connected to a suitable pressure source, such as a pump and/or compressor. When used in a submerged environment, fluid discharge apparatus 10 may be operated underwater by a diver. It has been found that the commingled stream of fluids produced by the apparatus is particularly effective in removing debris on submerged surfaces as the gas component of the discharged stream literally explodes upon contacting the surface thereby removing surrounding debris.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. An apparatus for discharging two commingled fluids separately supplied from pressurized fluid sources, said apparatus comprising:

a body having a first inlet chamber for receiving a liquid under pressure and an second inlet chamber for receiving a gas under pressure;

means for regulating the flow rate of said liquid between a minimum and maximum flow rate;

means for commingling said liquid and said gas;

means for inducing rotational flow of said commingled liquid and gas;

means for discharging said commingled liquid and gas.

2. An apparatus for discharging two commingled fluids according to claim 1, wherein said means for inducing rotational flow includes a barrel having an inner wall adapted with radially inward projecting, spirally disposed baffles.

3. An apparatus for discharging two commingled fluids according to claim 1, wherein said means for discharging said commingled liquid and gas includes a nozzle.

4. An apparatus for discharging two commingled fluids separately supplied from pressurized fluid sources, said apparatus comprising:

a body having a first inlet chamber for receiving a liquid under pressure and an second inlet chamber for receiving a gas under pressure;

means for regulating the flow rate of said liquid between a minimum and maximum flow rate;

said first and second inlet chambers each in communication with a commingling chamber wherein liquid and gas are commingled;

said commingling chamber in communication with a generally tubular barrel;

said barrel defining an inner wall having radially inwardly projecting, spirally disposed baffles for inducing rotational flow in commingled liquid and gas flowing therethrough, whereby an axial region of low pressure is formed and gas is drawn into said axial region resulting in a rotating stream of liquid surrounding a concentrically disposed stream of gas;

means for regulating discharge of said commingled liquid and gas.

5. An apparatus for discharging two commingled fluids according to claim 4, wherein said means for regulating the flow rate of said liquid includes an adjustable flow regulating mechanism in communication with said first fluid inlet chamber, said flow regulating mechanism defining a variable orifice for regulating flow of said liquid between minimum and maximum flow rates.

6. An apparatus for discharging two commingled fluids according to claim 4, wherein said means for regulating discharge of said commingled liquid and gas includes a trigger mechanism, said trigger mechanism having a first portion pivotally connected to said body and a second portion connected to said barrel, whereby actuation of said trigger mechanism causes longitudinal movement of said barrel away from said commingling chamber thereby allowing commingled liquid and gas to flow from said commingling chamber into said barrel.

7. An apparatus for discharging two commingled fluids separately supplied from pressurized fluid sources, said apparatus comprising:

a body having a first inlet chamber for receiving a liquid under pressure and an second inlet chamber for receiving a gas under pressure;

said first and second inlet chambers each in communication with a commingling chamber wherein liquid and gas are commingled;

means for regulating the flow rate of said liquid entering said commingling chamber between a minimum and maximum flow rate;

said commingling chamber having at least one outlet in communication with a generally tubular barrel, said barrel positionable between a first position wherein flow from said commingling chamber is prevented and a second position wherein flow from said commingling chamber is allowed;

means for biasing said barrel to said first position;

trigger means for manually positioning said barrel between said first and second positions;

said barrel defining an inner wall having radially inwardly projecting, spirally disposed baffles for inducing rotational flow in commingled liquid and gas flowing therethrough, whereby an axial region of low pressure is formed and gas is drawn into said axial region resulting in a rotating stream of liquid surrounding a concentrically disposed stream of gas;

a discharge nozzle in communication with said barrel.

8. An apparatus for discharging two commingled fluids according to claim 7, wherein said liquid is water and said gas is air.

9. An apparatus for discharging two commingled fluids according to claim 7, wherein said means for biasing said barrel to said first position includes a spring.

* * * * *